United States Patent [19]

van Raalte

[11] 4,259,611

[45] Mar. 31, 1981

[54] SEGMENTED SHADOW MASK

[75] Inventor: John A. van Raalte, Princeton, N.J.

[73] Assignee: RCA Corporation, New York, N.Y.

[21] Appl. No.: 33,965

[22] Filed: Apr. 27, 1979

[51] Int. Cl.[3] ..... H01J 29/07; H01J 31/20

[52] U.S. Cl. ..... 33/422; 313/402

[58] Field of Search ..... 313/422, 403, 402, 407

[56] References Cited

U.S. PATENT DOCUMENTS

| | | | |
|---|---|---|---|
| 4,028,582 | 6/1977 | Anderson et al. | 313/422 |
| 4,145,633 | 3/1979 | Peters et al. | 313/422 |

*Primary Examiner*—Robert Segal

*Attorney, Agent, or Firm*—Eugene M. Whitacre; Dennis H. Irlbeck; Lester L. Hallacher

[57] ABSTRACT

A display device includes an evacuated envelope having a plurality of support walls forming a plurality of parallel channels. A mosaic phosphor screen is deposited on a front wall of the envelope. A segmented shadow mask is mounted in spaced, parallel relation to the screen. A plurality of discrete mask segments are required to cover the screen. Each of the mask segments extends along substantially the full length of the channels. Mounting tabs extend from two oppositely disposed edges of the mask segment parallel to the major dimension of the channels.

5 Claims, 6 Drawing Figures

Fig.4
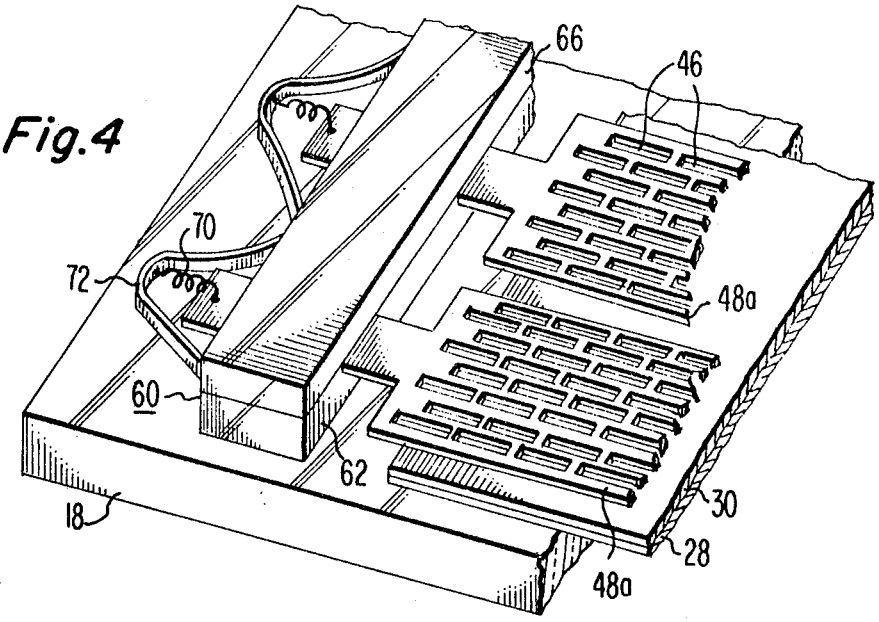
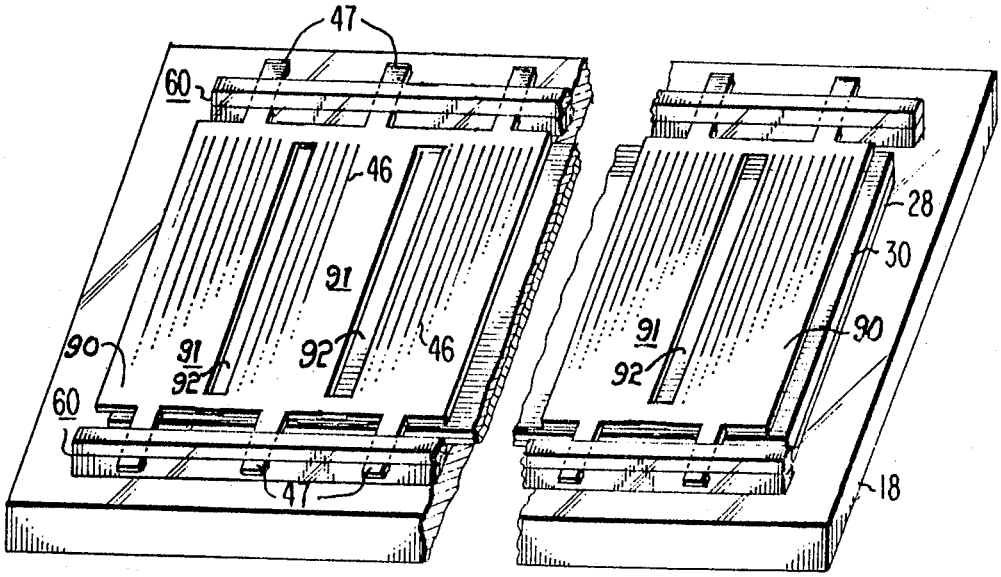
Fig.5

SEGMENTED SHADOW MASK

BACKGROUND OF THE INVENTION

The present invention relates to a flat panel display device having a plurality of internal support walls which form a plurality of parallel channels and particularly to a shadow mask structure for such a device.

U.S. Pat. No. 4,028,582 to Anderson et al., issued June 7, 1977, entitled "Guided Beam Flat Display Device," and now the subject of reissue application Ser. No. 862,188 filed Dec. 19, 1977, discloses a shadow mask extending across each of the channels and mounted on the internal support walls. Details of the shadow mask structure and how it is mounted on the support walls are not disclosed. The patent also does not discuss thermal expansion of the mounted shadow mask.

U.S. Pat. No. 4,145,633 to Peters et al., issued Mar. 20, 1979, entitled "Modular Guided Beam Flat Display Device," discloses a shadow mask mounted on the internal support walls and held in place by metal tips which extend from the support walls to the faceplate. A drawback of the Peters et al. structure is the complex retaining structure required to maintain the shadow mask between the metal tips and the support walls.

SUMMARY OF THE INVENTION

A display device includes an evacuated envelope having a plurality of support walls forming a plurality of parallel channels therein. A mosaic phosphor screen is deposited on a front wall of the envelope. A segmented shadow mask is mounted in spaced relation to the screen, a plurality of discrete mask segments being required to cover the screen. Each of the mask segments extends along substantially the full length of the channels. Mounting means extend from two oppositely disposed edges of the channels.

BRIEF DESCRIPTION OF THE DRAWINGS

FIG. 4 is an enlarged partial perspective view of the mask-support structure of FIG. 2, including the shadow mask tension springs.

FIG. 5 is a partial perspective view of an alternate mask-support structure in accordance with the present invention.

DETAILED DESCRIPTION OF THE PREFERRED EMBODIMENT

Figure 1:
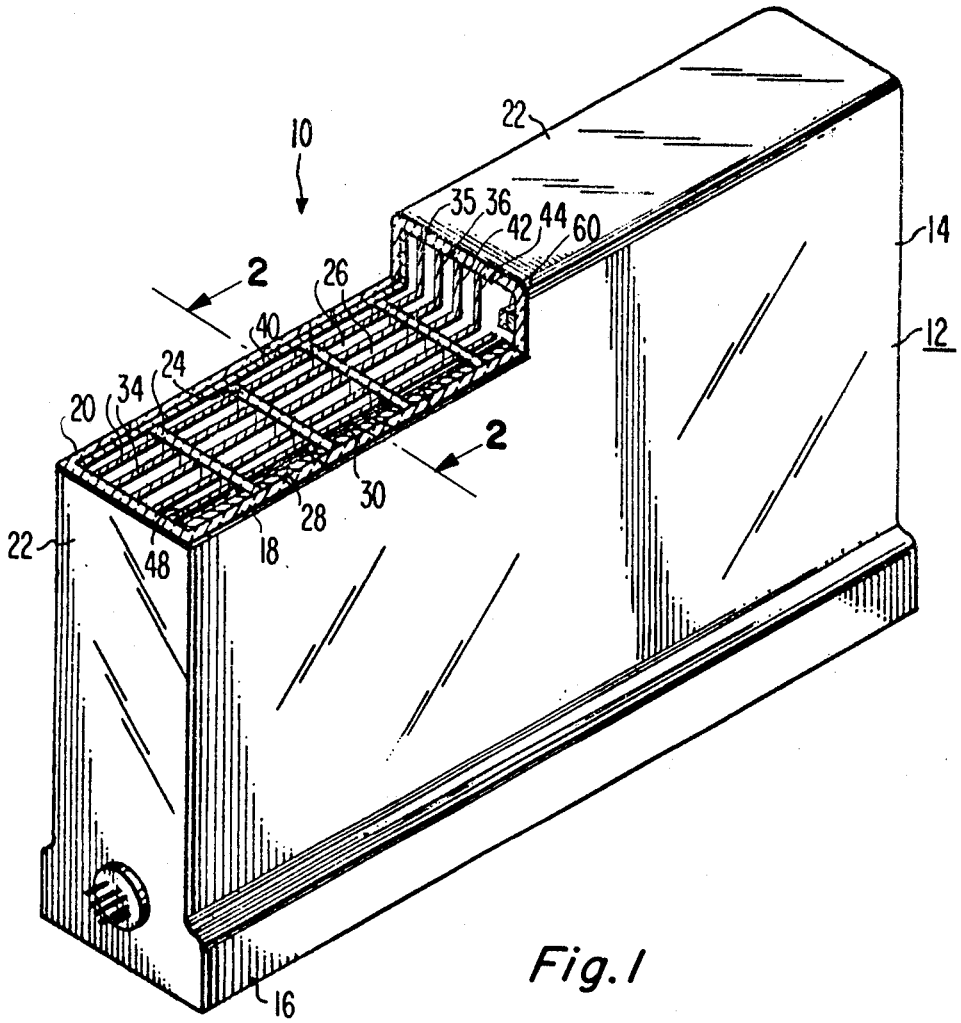
FIG. 1 is a perspective view partially broken away of a flat panel display device into which the present invention can be incorporated.
Figure 2:
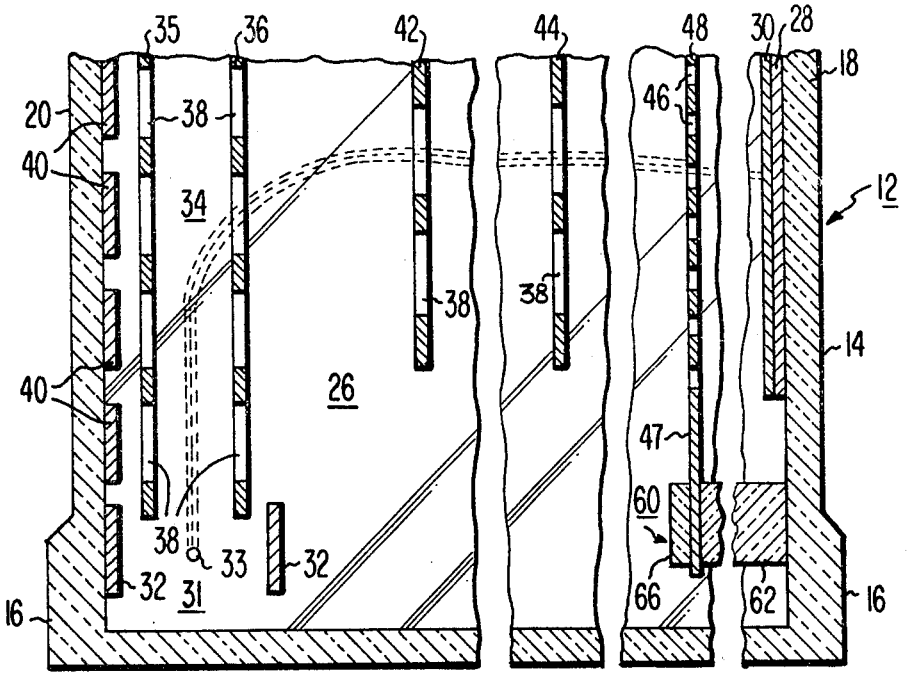
FIG. 2 is an enlarged sectional view taken along line 2—2 of FIG. 1.

Referring to FIGS. 1 and 2, one form of a flat display device utilizing the shadow mask structure of the present invention is generally designated as 10. The display device 10 comprises an evacuated envelope 12, typically of glass, having a display section 14 and an electron gun section 16. The display section 14 includes a rectangular front wall 18 and a rectangular back wall 20 in spaced, parallel relation with the front wall 18. The front wall 18 and back wall 20 are connected by side walls 22. The front wall 18 and back wall 20 are dimensioned to provide the size of the display desired, e.g., 75 by 100 cm, and are spaced apart about 2.5 to 7.5 cm.

A plurality of spaced, parallel support walls 24 extend between the front wall 18 and the back wall 20 and from the gun section 16 toward the opposite side wall 22. The support walls 24 provide the desired internal support for the evacuated envelope 12 against external atmospheric pressure and divide the display section 14 into a plurality of channels 26. On the inner surface of the front wall 18 is a mosaic phosphor screen 28. The phosphor screen 28 may be of any well known type presently being used in color television display tubes. Preferably, the screen 28 comprises three interlaced arrays of different color emitting phosphor lines separated by a light-absorbing matrix. A metal film electrode 30 is provided on the phosphor screen 28.

The gun section 16 as shown in FIGS. 1 and 2 is an extension of the display section 14 and extends along one end of the channels 26. The gun section may be of any shape suitable to enclose a particular gun structure 31 contained therein. The electron gun structure 31 contained in the gun section 16 may be of any well known construction suitable for generating three beams of electrons into each of the channels 26. For example, the gun structure may comprise a plurality of individual guns mounted at the ends of the channels 26 for directing separate beams of electrons into the channels. Alternatively, the gun structure 31 may include a plurality of modulation electrodes 32 and a line cathode 33 extending along the gun section 16 between the modulation electrodes 32. The line cathode 33 also extends across the end of the channels 26 and is adapted to generate electrons which can be selectively directed as individual beams into the channels. A gun structure of the line type is described in U.S. Pat. No. 4,121,130 issued to R. A. Gange on Oct. 17, 1978 and entitled "Cathode Structure and Method of Operating the Same."

In each of the channels 26 is a beam guide 34 for focusing and periodically confining electrons into beams which travel in a path along the guide 34. The guide 34 includes a pair of elongated, spaced apart, parallel first and second guide grids 35 and 36 respectively, each having a plurality of apertures 38 therethrough. The apertures 38 are arranged so as to define a plurality of rows transversely across and columns longitudinally along the guide grids 35 and 36. A plurality of spaced, parallel conductors 40 are disposed on the inner surface of the back wall 20 and extend transversely across the channels 26. The conductors 40 are strips of an electrically conductive material, such as metal, coated on the back wall 20. Each of the conductors 40 lies directly opposite a transverse row of apertures 38 in the first guide grid 35. Means are provided for deflecting the beam out of the guide and toward the phosphor screen 28 at various points along the length of the channels 26.

In each of the channels 26 a focusing grid 42 may be located in spaced relation between the beam guide 34 and the metal film electrode 30 on the phosphor screen 28. An accelerating grid 44 may be interposed between the focusing grid 42 and the metal film electrode 30. The focusing grid 42 and the accelerating grid 44 also have a plurality of apertures 38 therethrough. Grids 42 and 44 serve as focusing and accelerating means, respectively, for the electron beams as the beams flow from the beam guide 34 to the phosphor screen 28. An apertured, frameless, rectangular shadow mask 48 is positioned in the envelope 12, adjacent to the front wall 18 in spaced parallel relation to the phosphor screen 28. The shadow mask 48 extends across the channels 26 along substantially the entire length of the channels 26 between the support walls 24, unrestricted by the support walls. The mask 48 serves as a color selection electrode for electron beams flowing from the beam guide 34 to the phosphor screen 28.

Figure 3:
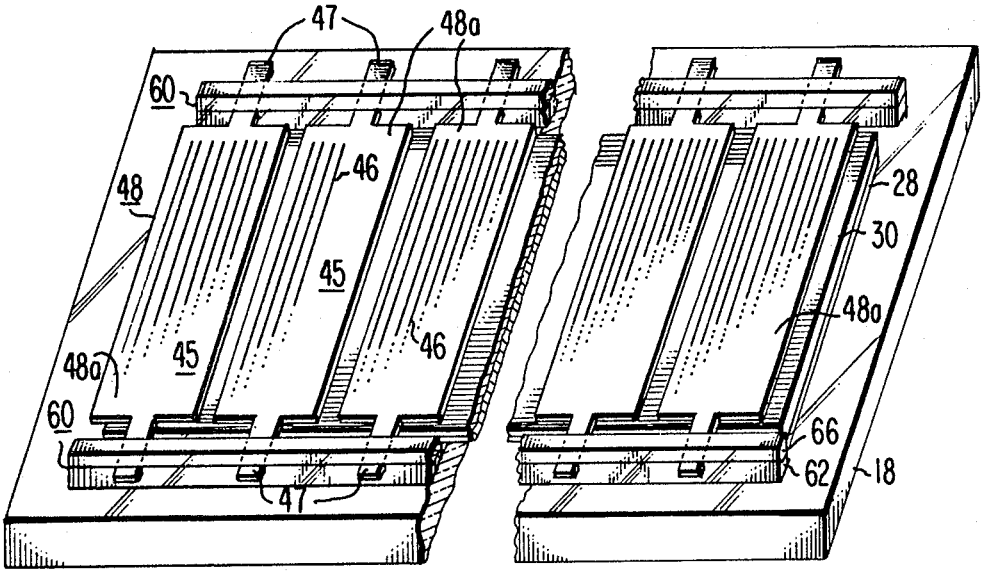
FIG. 3 is a partial perspective view of the mask-support structure of FIG. 2.

As shown in FIGS. 2–4, the shadow mask 48 is secured by mounting means 47, e.g., tabs to a shadow mask suspension system 60 located at the two oppositely disposed edges of the mask, which extend along the channels.

The shadow mask is formed from a sheet of metal such as cold rolled steel and includes an active portion 45 having an array of elongated aperatures 46 therein. The active portion is that portion which overlies the phosphor screen 28 and provides the shadowing or color selection function. For a phosphor screen 28 made up of spaced longitudinally extending strips, the apertures 46 are arranged in longitudinally extending vertical columns parallel to the phosphor strips. The column-to-column spacing between the apertures 46 is equal across each of the channels 26.

Of principal concern in any embodiment having a vertical line screen 28 and a mask 48 having elongated apertures 46 is the prevention or at least minimization of the effective horizontal motion of the mask. Such motion can be caused by thermal expansion of the mask 48 in the horizontal direction, that is, the direction of high frequency scan. Motion of the mask in the vertical direction is of little consequence since the mask apertures 46 and the phosphor strips on the line screen 28 will still remain aligned. In the preferred embodiment shown in FIGS. 3 and 4, the minimization of the effective horizontal motion of the mask 48 is achieved by fabricating the mask 48 as a plurality of discrete, identical mask segments 48*a*. Each of the mask segments 48*a* spans one of the channels 26. For example, if each of the channels 26 has a horizontal dimension of about 2.5 cm, the thermal expansion of each of the mask segments 48*a* in the horizontal dimension is negligible for all operating conditions of the display device and horizontaol registration between the mask apertures 46 and the phosphor strips on the line screen 28 is assured.

Each of the mask segments 48*a* is coplanar with, adjacent to, and spaced apart from at least one of the other mask segments 48*a*. The spacing between adjacent mask segments 48*a* is sufficient to permit one of the support walls 24 (not shown) to pass therebetween without contacting the shadow mask segments 48*a*.

Interconnection between the mask segments 48*a* and the front wall 18 is made by means of a novel shadow mask suspension system 60. The shadow mask suspension system is described more fully in my copending application entitled "Modular Tube Shadow Mask Support System." Briefly, the suspension system 60 comprises two support bars 62 either integral with or fixedly attached in substantially mutual parallel relation to the front wall 18 on opposite sides, viz. top and bottom, of the phosphor screen 28. The support bars 62 have their major axes aligned parallel to the direction of high frequency scan, which is the horizontal direction. The support bars 62 may be made of glass or another suitable material having a coefficient of thermal expansion that is substantially equal to that of the front wall 18. The support bars 62 may have a plurality of slots 64 (not shown) formed in the distal surface of each of the support bars 62 to accommodate the shadow mask mounting tabs 47 extending from the vertical edges of the shadow mask segments 48*a*. Such slots provide horizontal registration between the apertures 46 of the mask segments 48*a* and the phosphor stripes of the line screen 28.

As shown in FIGS. 2–4, locking bars 66 may be attached to the distal surface of each of the support bars 62 to slidably retain the shadow mask mounting tabs 47 within the support bar slots 64 (not shown).

Vertical position of the mask segments 48*a* with respect to the screen 28 is held by means of a biasing means including tension springs 70 and spring supports 72 attached to the mounting tabs 47 as shown in FIG. 4.

Alternatively, one of the shadow mask mounting tabs 47 may be fixedly attached to one end of the shadow mask suspension system 60 while the mounting tab 47 at the other end of the mask segment 48*a* may be slidably attached to the suspension system as described above to allow for thermal expansion.

Fabrication of the shadow mask segments 48*a* begins with coating a metal sheet on both sides with a suitable photoresist and exposing the two sides of the sheet through two photomasters having the desired aperture patterns. Included in the photomaster patterns are appropriate patterns for creating the mounting tabs 47. Following exposure, the metal sheet is etched with a suitable etchant until all the openings in the mask are formed. The process is repeated for each mask segment 48*a* comprising mask 48.

Another embodiment of the present novel mask structure is shown in FIG. 5. In this embodiment, a mask segment 90 spans a plurality of channels 26. The mask segment 90 includes at least two active areas 91 separated by at least one wall slot 92. The construction of the active portion 91 of each of the mask segments 90 is similar to the active portion 45 of mask segments 48*a* and differs only in the location of the wall slots 92 which are not required in the preferred embodiment described above. Each of the wall slots 92 permits one of the support walls 24 (not shown) to pass through the shadow mask segment 90 and contact the front wall 18. The wall slots 92 are dimensioned to permit the support walls 24 to pass therethrough without restricting the mask segments 90. The maximum dimension of the mask segment 90 along the direction of high frequency scan, e.g., the horizontal dimension in this embodiment is determined by the coefficient of expansion of the mask material. For stable metals, for example Invar, the mask may span a greater number of channels than if the mask is fabricated from cold-rolled steel. The walls slots 92 may be included in the photomaster patterns used to expose the mask apertures 46.

As in the preferred embodiment described above, each of the mask segments 90 is supported by mounting means, e.g., a plurality of pairs of tabs 47, disposed at each end of the mask segments. An advantage of this alternate embodiment is the reduction in the number of critical alignments between the support bar slots 64 and the pairs of mounting tabs 47. For example, to assure horizontal registration between the apertures 46 of the many segments 90 and the phosphor stripe on the line screen 28, only one accurately dimensioned pair of support bar slots 64 and mounting tabs 47 are required for each mask segment 90. The remaining support bar slots may have a horizontal dimension wider than the horizontal dimension of the remaining tubes 47 since these remaining slots provide only lateral stability for the mask segments 90.

Figure 6:
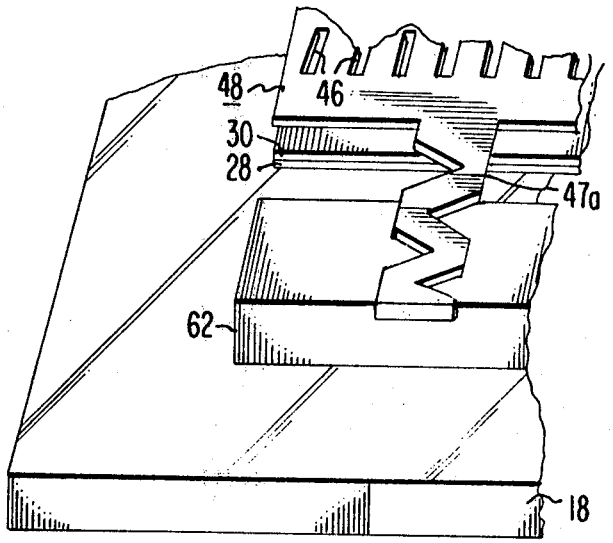
FIG. 6 is an enlarged partial perspective view of an integral shadow mask tension spring.

As shown in FIG. 4, the tension springs used to position the mask segments in the vertical position may be a plurality of discrete springs 70 connected to the mounting tabs 47 so as to apply tension perpendicular to the direction of the high frequency scan. Alternatively, as shown in FIG. 6, the tension springs may be integral springs 47*a* etched into the mounting tab 47. The etched springs 47*a* may be included in the photomaster patterns used to expose the mask apertures described above.

Although the foregoing embodiments are described with respect to flat shadow mask type tubes wherein a mask and screen are held at the same electrical potential, it should be understood that the present invention is also applicable to other shadow mask type tubes such as to a tube where the mask and screen are held at different potentials. Such tubes are also known as focus mask or focus shadow mask tubes.

I claim:

1. In a display device having an evacuated envelope, a plurality of support walls within said envelope partitioning said envelope into a plurality of parallel channels, an electron beam guide in each of said channels, electron generating means disposed at one end of each of said beam guides, a mosaic phosphor screen on an inner surface of said envelope, and a multiapertured shadow mask mounted in spaced relation to said screen, the improvement comprising:

said shadow mask being segmented so that a plurality of discrete segments are required to cover the entire screen, each of said mask segments extending along substantially the full length of said channels and spaced apart from at least one other of said mask segments so that one of said support walls can pass between adjacent mask segments free from contact with said mask segments, each of said mask segments further comprising means at each end thereof for mounting said mask segment relative to said screen.

2. The display device as in claim 1 wherein each of said mask segments span a plurality of adjacent channels.

3. The device as in claim 2 wherein each of said mask segments has at least one slot therethrough which permits one of said support walls to pass through said slot to support said front wall.

4. The device as in claim 1 wherein the maximum mask segment dimension along the high frequency scan direction is determined by the coefficient of expansion of the mask material, said maximum dimension being selected to assure that horizontal registration between said mask apertures and said line screen is assured for all operating conditions.

5. The device as in claim 4 wherein each of said mask segments is substantially flat.

* * * * *